United States Patent [19]

Yamamoto et al.

[11] 4,049,876

[45] Sept. 20, 1977

[54] CEMENTED CARBONITRIDE ALLOYS

[75] Inventors: Takaharu Yamamoto; Toshio Nomura; Tsuyoshi Asai; Akio Hara, all of Itami, Japan

[73] Assignee: Sumitomo Electric Industries, Ltd., Osaka, Japan

[21] Appl. No.: 743,212

[22] Filed: Nov. 18, 1976

Related U.S. Application Data

[63] Continuation of Ser. No. 620,853, Oct. 8, 1975, abandoned.

[30] Foreign Application Priority Data

| | | |
|---|---|---|
| Oct. 18, 1974 | Japan | 49-120734 |
| Oct. 18, 1974 | Japan | 49-120735 |
| Oct. 18, 1974 | Japan | 49-120736 |
| Oct. 18, 1974 | Japan | 49-120737 |
| Oct. 18, 1974 | Japan | 49-120738 |
| Feb. 26, 1975 | Japan | 50-24357 |
| Feb. 27, 1975 | Japan | 50-24587 |

[51] Int. Cl.[2] ..... B22F 3/00; C22C 29/00

[52] U.S. Cl. ..... 428/932; 75/203; 75/204; 75/175.5; 75/205; 75/227; 75/238; 75/241; 75/242; 148/126

[58] Field of Search ..... 29/182.1, 182.8, 182.5; 75/203, 204, 205, 227, 175.5; 148/126

[56] References Cited

U.S. PATENT DOCUMENTS

| | | | |
|---|---|---|---|
| 3,479,155 | 11/1969 | Rudy | 29/182.1 |
| 3,671,201 | 6/1972 | Bergna | 29/182.5 |
| 3,703,368 | 11/1972 | Rudy | 75/175.5 |
| 3,741,733 | 6/1973 | Kieffer | 75/204 |

FOREIGN PATENT DOCUMENTS 2,219,409 11/1972 Germany

OTHER PUBLICATIONS

Chem. Abstract No. 76;17124k, vol. 76, p. 179, 1972.

*Primary Examiner*—Brooks H. Hunt
*Attorney, Agent, or Firm*—Wenderoth, Lind & Ponack

[57] ABSTRACT

This invention relates to a cemented carbonitride alloy in which the hard phase consists of $$[(\text{Group IVa metal})_A(\text{Group Va metal})_B(\text{Group VIa metal})_C]\text{-}(C_XN_Y)_Z$$

wherein A, B, C, X and Y are respectively mole fractions, Z is a mole ratio of the metalloid components to the metal components and there are among A, B, C, X, Y and Z the relations of $$A + B + C = 1, X + Y = 1,$$

$$4A + 5B + 6C + 4XZ + 5YZ \geqq 8.6,$$

$$0.05 \leqq Y \leqq 0.50 \text{ and } 0.85 \leqq Z \leqq 1.0.$$

The hard phase is combined by at least one binder metal from the iron group and there are in the alloy structure WC phase and the hard phase having the crystal structure B1 and containing Ti in a proportion of at least 20 atomic percent to the metallic atoms.

11 Claims, 1 Drawing Figure

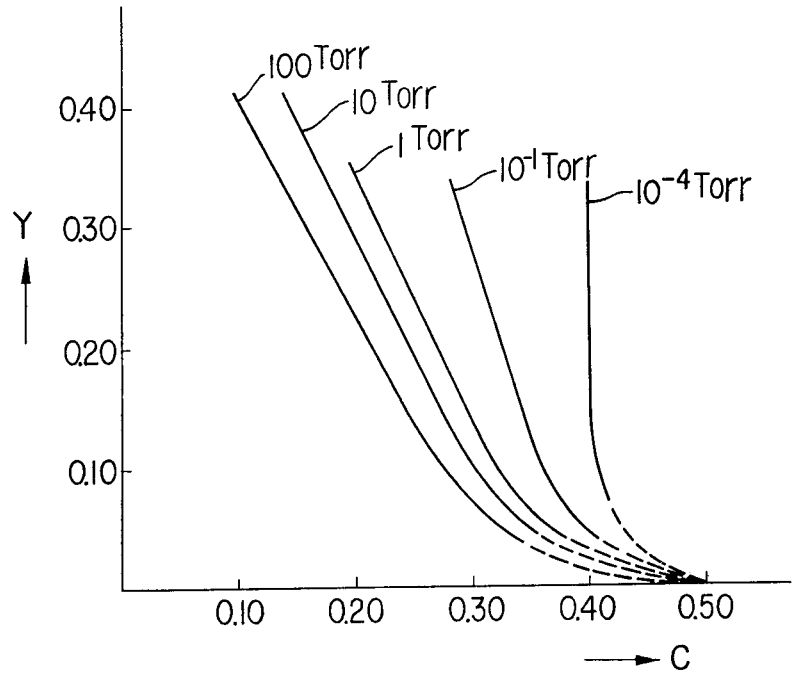
100 Torr
10 Torr
1 Torr
$10^{-1}$ Torr
$10^{-4}$ Torr
Y
0.40
0.30
0.20
0.10
0.10
0.20
0.30
0.40
0.50
C

CEMENTED CARBONITRIDE ALLOYS

This application is a continuation of Ser. No. 620,853, filed Oct. 8, 1975, now abandoned.

BACKGROUND OF THE INVENTION

This invention relates to cemented carbonitride alloys containing titanium (Ti) and tungsten (W), whose cutting property is markedly improved.

Titanium carbide (TiC) base alloys are superior to tungsten carbide (WC) alloys in oxidation resistance and wear resistance when used as a cutting tool, in addition to the low price and light weight of the former.

The TiC base alloys having these excellent properties have been watched with keen interest as a promising material for tools and various alloys of this kind have been proposed, but the scope of the intended use thereof is considerably limited, because of the low toughness, large edge deformation when cutting is carried out at a high temperature and high pressure and tendency of breaking in a cutting operation with a heat cycle such as in an intermittent cutting, as is well known in the art.

It has been considered that the essential difference between the TiC base alloy and WC base alloy of the prior art, in particular, the difference of toughness, is due to that of TiC crystal and WC crystal. For example, it is well known that WC crystal is very excellent in strength and plastic deformation resistance at a high temperature and it is assumed that even if another element such as W is dissolved in TiC, the property of TiC itself is scarcely changed and such a high temperature strength that WC has cannot be given to TiC. Therefore, it is necessary to retain a WC phase in TiC base alloys in order to impart to TiC base alloys strength and plastic deformation resistance similar to those of WC base alloys. The other important property, in particular, wear resistance in cutting steels, increases generally with the decrease of WC phase where the hard phase consists of W, Ti and C or with the decrease of the quantity of W in the hard phase of B1 type (MC phase) due to decrease of the reaction of W and steel. That is to say, the wear resistance deteriorates generally with the increase of the content of W.

In a system of Ti-W-C under normal sintering condition at a temperature of lower than 1600° C, for example, there is only a (Ti, W)C phase (MC phase) corresponding to the crystal structure B1 if the quantity of W is less than the boundary line of $(Ti_{0.5}W_{0.5})C$ and there are deposited WC phase and MC phase if more than that. Therefore, it is impossible to deposit WC phase if the concentration of W is lowered. In the MC phase, the position of M can be substituted by one or more high melting point metals of Groups IVa, Va and VIa (Periodic Table) and the position of C can be substituted by N.

It is reported by R. Kieffer, P. Ettmayer and M. Freudhofmeier, Metall 25, (1971) p. 1335 that the strength properties of cemented titanium carbonitrides as a tool material for high speed finish of steels can be improved. Competitive carbonitride alloys for high speed finishing of steels and super alloys are only recently achieved through use of a novel decomposition reaction on the system Ti-Mo(W)-C-N, but, because of their low thermal conductivity, these carbonitrides are not suitable for interrupted cuts and milling operations at heavy feed rates.

SUMMARY OF THE INVENTION

It is an object of the invention to provide a TiC base alloy whereby the above described disadvantages of the prior art can be overcome.

It is another object of the invention to provide an improved cemented carbonitride alloy with excellent toughness, strength and wear characteristics.

It is a further object of the invention to provide a process for the production of an improved cemented carbonitride alloy by sintering in a nitrogen atmosphere.

These objects can be attained by a cemented carbonitride alloy in which the hard phase consists of $$(\text{Group IVa metal})_A(\text{group Va metal})_B(\text{Group VIa metal})_C(C_XN_Y)_Z,$$

wherein $A$, $B$, $C$, $X$ and $Y$ are respectively mole fractions, $Z$ is a mole ratio of the metalloid components to the metal components and there are among $A$, $B$, $C$, $X$, $Y$ and $Z$ relations of $$A + B + C = 1, X + Y = 1,$$

$$4A + 5B + 6C + 4XZ + 5YZ \geqq 8.6, .$$

$$0.05 \leqq Y \leqq 0.50 \text{ and } 0.85 \leqq Z \leqq 1.0.$$

The hard phase is combined by at least one binder metal from the iron group and there are in the alloy structure WC phase and the hard phase having the crystal structure B1 and containing Ti in a proportion of at least 20 atomic percent to the metallic atoms.

BRIEF DESCRIPTION OF THE DRAWING

The FIGURE shows graphically the relation of a critical line of WC phase deposition and a nitrogen partial pressure where various compositions of $(Ti_{1-C}W_C)(C_{1-Y}N_Y)_Z$ are sintered at 1450° C with Co. The nitrogen partial pressure $P_{N_2}$ is measured at sintering and the composition of the hard phase is represented by that at mixing. On the right side of the curve, WC phase is deposited and on the left side, there is no deposition of WC phase.

DETAILED DESCRIPTION OF THE INVENTION

The important feature of the present invention consists in the finding that, if a part of C in the MC phase is replaced by N, the WC-depositing zone is shifted to the low concentration side of W. That is to say, it is surprisingly found that the wear resistance of an alloy can be held similar to that of the TiC base alloy of the prior art, and the toughness can be increased to the level of the WC base alloy of the prior art, by the co-existence of the WC phase together with an M(C, N) hard phase in a zone having a qunatity of W less than $(Ti_{0.5}W_{0.5})C$, which has been considered impossible in the system Ti-W-C.

The foregoing description is limited to the most fundamental system Ti-W-C-N only, but the basic phenomenon is of course applicable where a part of Ti is substituted by one or more transition metals of Groups IVa, Va and VIa of the Periodic System. The theoretical basis of the present invention will now be illustrated.

The valence electron concentration which will hereinafter be referred to as VEC is an indication to take the stability of the hard phase into consideration. The molecular formula of the hard phase contained in the alloy according to the present invention is generally represented by $$[(\text{Group IVa metal})_A(\text{Group Va metal})_B(\text{Group VIa metal})_C](C_XN_Y)_Z \quad (1)$$

in which $A + B + C = 1$ and $X + Y = 1$.

Thus VEC can be calculated by the following equation as well known.

$$VEC = 4A + 5B + 6C + 4XZ + 5YZ \quad (2)$$

We have examined the VEC value calculated from analysis and the deposition of WC as to various carbonitride systems of Groups IVa, Va and VIa including W ($0.05 \leqq Y \leqq 0.50$) and consequently found that the VEC value of the boundary composition where WC is deposited is somewhat varied with the nitrogen partial pressure, sintering temperature and composition, but the VEC value of the boundary composition between one phase zone of M(C,N) and two phase zone of M(C,N) + WC is approximately 8.6 in the case of $0.85 \leqq Z \leqq 1.0$.

When $VEC < 8.6$, the crystal is stable, but when $VEC \geqq 8.6$, the crystal is unstable. Furthermore, where W is contained in this unstable carbonitride crystal, the following reaction takes place to deposit WC:

$$(M_O.M'_P, \ldots, W_U)(C_XN_Y)_Z \rightarrow (M_O.M'_P, \ldots, W_{U'})(C_XN_Y)_Z + (U-U')WC \quad (3)$$

wherein $U \geqq U'$ and $0.85 \leqq Z \leqq 1.0$.

The quantity of WC phase can be increased and, simultaneously, the content of W in the M(C,N) phase can be reduced by chosing the composition of the hard phase so as to give VEC $\geqq$ 8.6.

Even if an alloy having a composition from which WC phase is to be deposited is prepared, however, WC phase is not deposited and the desirable property is not given in some case. This is due to release of nitrogen during the sintering or to the fact that WC phase is all dissolved in the binder phase. In order to prevent the former phenomenon, the sintering should be carried out at a nitrogen partial pressure of several hundred Torr or less depending on the composition or a carbonitride containing Ti and W should be used as a starting material, while in order to prevent the latter phenomenon, sintering or hotpressing at a high temperature should be avoided.

The former case will now be illustrated in detail. In the case of sintering an alloy having a hard phase consisting of the simplest (Ti,W)(C,N) with a binder metal, Co, the boundary between a two phase zone of M(C,N) + Co and three phase zone of M(C,N) + WC + Co is as shown graphically in the accompanying drawing, based on the composition at the time of blending, and, as is evident from this FIGURE, the boundary line is markedly affected by the nitrogen partial pressure in the sintering atmosphere. In a vacuum sintering under a pressure of $10^{-4}$ mmHg or less, for example, there is no deposition of WC phase within a composition range having a larger content of Ti than $(Ti_{0.60}W_{0.40})(C,N)$. When WC is added to the composition from the start and subjected to vacuum sintering in a short time to prepare an alloy that is not in a state of equilibrium, of course, the residual WC phase can be found sometimes in the alloy, but the WC phase on the surface layer of the alloy vanishes even in this case. This is due to the fact that (Ti,W)(C,N) is decomposed to thus release nitrogen. That is to say, the decomposition depends on the chemical potential of carbon and nitrogen, but, in the case of the FIGURE wherein the sintering is carried out using a furnace with a carbon heater, the chemical potential of carbon is constant and, accordingly, the boundary line is shifted by the nitrogen partial pressure only.

This phenomenon is similarly applicable in other cemented carbonitride alloys having a composition of hard phase as represented by formula (1), but the tendency of releasing nitrogen increases with the order of Group IVa metals, Group Va metals and Group VIa metals.

In order to increase VEC, it is preferable to hold the quantity of nitrogen as much as possible. If too much of an excess is used, however, the sintering property of an alloy is deteriorated, while if too little is used, on the other hand, there is little effect. Therefore, the condition of $0.05 \leqq Y \leqq 0.50$ is preferable in the representation of Formula (1) and the optimum range is within $0.10 \leqq Y \leqq 0.40$.

As to the limitation of Z in Formula (1), when $Z > 1$, free carbon is deposited and when $Z < 0.85$, an $\eta$ type brittle phase such as $Co_3W_3C$ is deposited to embrittle the alloy. Therefore, the condition of $0.85 \leqq Z \leqq 1$ as set forth is desirable.

In Formula (1) above, Group IVa elements mean Ti, Zr and Hf. Zr is capable of raising the wear resistance, but lowers the toughness, and Hf is very expensive, in particular, when using a large amount thereof. Therefore, it is preferable to add Ti in a proportion of A/2 or more. Furthermore, Ti must be in a proportion of at least 20 atomic % to the metals contained in the hard phase, because Ti is relatively cheap and capable of increasing the sintering property of the alloy as well as raising the strength of the hard phase. In view of one aspect of the invention that WC phase is caused to coexist by adding nitrogen to a carbide having a composition from which WC phase is not deposited if there is no nitrogen, the feature of our alloy can most favourably be given within a zone satisfying the relation of $A \geqq C$ in Formula (1). There is also found a remarkable improvement of the property within a zone satisfying the relation of $A + B \geqq 0.6$, in which no WC phase is deposited by the ordinary vacuum sintering method as described above, although partly overlapped with the zone of $A \geqq C$. Even in an alloy within a range of $A \leqq C$ or $A + B \leqq 0.6$, WC phase is increased and the property is more improved than that of the ordinary cemented carbides, but the hard phase of B1 type is naturally decreased and the effective zone is shifted to a high nitrogen zone. In this case, the property of the alloy is effectively improved within a range wherein the quantity of nitrogen in the solid solution of B1 type amounts to approximately 15 to 50 mole % and more effectively within a range of about 25 to 50 mole %. Representing this fact in connection with the whole composition of the hard phase including the quantity of WC deposited, the remarkable effect can be obtained when $1 - 5Y = C = 1 - 2Y$, preferably, $1 - (10/3)Y = C = 1 - (10/5)Y$, more particularly, $1 - (10/3)Y = C = 1 - (10/4)Y$.

In Formula (1) above, Group Va elements mean V, Nb, and Ta. These elements are capable of increasing the toughness of the alloy. Above all, Nb and Ta have more excellent effects. However, their effects on wear resistance are situated between Groups IVa metals and Group VIa metals and addition of a large quantity thereof is uneconomical. Therefore, the quantity of Group Va metal to be added is generally adjusted so that the relation of $A = B$ is satisfied in Formula (1). In general, Group Va metal is added in a proportion of 2 to 70% by weight, preferably, 5 to 50% by weight based on the whole alloy composition.

In Formula (1), Group VIa elements means Cr, Mo and W. W is an essential element for the cemented carbonitride alloy of the present invention, which is characterized by the presence of WC crystal. Mo is capable of increasing the sintering property of the alloy and Cr is capable of raising the corrosion resistance of the alloy.

The binder phase of the cemented alloy according to the present invention is 0.01 to 0.5 times by weight as much as the carbide phase, since if less than 0.01 times, the alloy is embrittled and if more than 0.5 times, the alloy has too low a heat resistance to be put to practical use. The iron group metals such as Fe, Co and Ni are suitable as the binder metal. Since these metals contain the construction elements of the hard phase in forming a binder phase, it is also effective to alloy the construction elements of the hard phase with Fe, Co or Ni or to use a mixture thereof as a binder metal.

With respect to improvement of the property of such a binder metal, there is a problem characteristic of an alloy containing nitrogen. As described above, the alloy of the invention needs sintering in a nitrogen atmosphere, so nitrogen is dissolved in the melted metal during sintering and evolved sometimes as bubbles during cooling after the sintering. This phenomenon is a cause of embrittlement of the alloy, which should therefore be avoided. To this end, it is effective to increase the cooling speed of the alloy and, in particular, it is preferable to keep the cooling speed from the sintering temperature to the liquid phase-vanishing temperature at a rate of 20° C/min or more. Another method consists in holding the absolute pressure of the atmosphere during cooling higher than that during sintering, thereby preventing generation of bubbles.

In one embodiment of the present invention, the following composite alloy can be prepared. As apparent from Formula (1), *VEC* is increased as the value of *Y* (qunatity of N) is increased, when *A, B, C* and *Z* are constant. Considering a case where VEC of a nitrogen-containing alloy is slightly larger than 8.6, WC phase is present in this alloy, but, if a part of the nitrogen is substituted by carbon to decrease VEC to smaller than 8.6, the WC phase in the alloy vanishes. Considering alloys having substantially constant composition, furthermore, the WC phase-free alloy shows an increased wear resistance but a decreased toughness. Therefore, an alloy with an excellent wear resistance can be obtained without lowering its toughness, if a WC phase-free surface layer is provided on an alloy consisting of the B1 crystal phase, WC phase and binder metal phase.

Preparation of such an alloy can be carried out by choosing a nitrogen-containing alloy composition so as to give a VEC of slightly larger than 8.6 and reheating the composition during or after sintering to reduce the content of nitrogen in the surface layer and to reduce VEC to smaller than 8.6, thus obtaining an alloy with a WC phase-free surface layer. The reheating during or after sintering to reduçe the content of nitrogen in the surface layer can be preferably effected in vacuo or in a carburizing atmosphere.

In another case where a starting composition has a VEC of considerably larger than 8.6, a similar effect can be obtained and the wear resistance of the surface can be increased by reducing the content of nitrogen in the surface layer thereby reducing the quantity of WC of the surface.

Furthermore, the following effect can also be produced by reducing the content of nitrogen in the surface layer in addition to the above described effect. When the reheating treatment is carried out in vacuo, in particular, the surface nitrogen is evolved and carbon is diffused from the interior, resulting in decrease of Y and thus Z. Therefore, the decrease of nitrogen plays a role similar to the decrease of carbon in the systems of WC-TiC-Co, WC-TaC-Co and WC-TiC-TaC-Co as reported in H. Suzuki and K. Hayashi: Trans. J. Japan Inst. Metals 7 (1966), page 99; 8 (1967) page 253; 9 (1968) page 77; and H. Suzuki and T. Yamamoto: Inst. J. Powder Met. 3 (1967) page 17, thus resulting in increase of the quantity of W dissolved in the binder phase (Co and/or Ni), and a further decrease of nitrogen results in deposition of $\eta$ phase ($Co_3W_3C$). When a large amount of W is incorporated in the binder phase, the binder phase is hardened to increase the wear resistance of the alloy. Deposition of a small amount of $\eta$ phase proves effective for increasing the wear resistance of the alloy.

The present invention will be further illustrated in greater detail in the following examples. It will be self-evident to those skilled in the art that the ratios, ingredients in the following formulation and the order of operations can be modified within the scope of the present invention. Therefore, the present invention is not to be interpreted as being limited to the following examples. All parts, percents and the like are to be taken as those by weight unless otherwise indicated.

EXAMPLE 1

$WO_3$ powder having a grain size of 0.3 micron (by Fischer's Sub Sieve Sizer) and $TiO_2$ powder having a grain size of 0.2 micron were mixed to give an atomic ratio of W : Ti = 0.2 : 0.8, mixed with carbon powder in a proportion of 2 times as much as W + Ti and ball milled with care to prevent the powder from aggregation. The resulting mixture was granulated by compressing under a pressure of 1 ton/cm$^2$ and then ground to in a gain diameter of 1 mm or less. The granulated powder was held and reacted in the furnace heated at 1600° C in $N_2$ atmosphere for 1 hour and further heated at 1800° C in $H_2$ atmosphere for 1 hour and finally at 1500° C in $N_2$ atmosphere for 1 hour.

Analysis of the resulting carbonitride showed 7.78% total carbon, 0.50% free carbon 0.09% oxygen and 2.7% nitrogen. The mole ratio of N/(C + N) was 23.7%. 40% of this carbonitride, 52% of a moderate grain WC powder and 8% of Co were mixed, ball milled by wet process for 96 hours, dried, formed under a pressure of 1 ton/cm$^2$ and the formed body was subjected to reduced pressure sintering at a sintering temperature of 1350° to 1450° C for 1 hour under a nitrogen partial pressure of 50 Torr and successively cooled to 1300° C at the speed of 20° C/min. under a nitrogen partial pressure of 100 Torr to prepare an alloy (1) having a transverse rupture strength of 160 kg/mm$^2$ and VHN (Vickers Hardness Number) of 1600.

When a cutting insert of SNP 432 was made from this alloy to a workpiece of SK 5 was subjected to cutting for 10 minutes under conditions of a cutting speed of 130 m/min, cutting depth of 2 mm and feed of 0.36 mm/rev, this alloy was superior to an alloy having the same composition except nitrogen, being obtained from the commerical (W,Ti)C, in crater depth by 40% and in flank wear by 20%.

EXAMPLE 2

Several mixed carbonitride powders were prepared in an manner analogous to Example 1. The resulting mixed carbonitrides had analytical chemical compositions of $(Ti_{0.75}W_{0.25})(C_{0.73}N_{0.27})_{0.95}$, $(Ti_{0.80}W_{0.20})(C_{0.74}N_{0.26})_{0.95}$ and $(Ti_{0.84}W_{0.16})(C_{0.73}N_{0.27})_{0.96}$ by representation of atomic ratio. X-ray diffraction showed that these mixed carbonitrides consisted of one phase of B1 type. Using these carbonitrides as a raw material, alloys (2) to (6) were prepared according to the recipe of Table 1 under sintering conditions of: nitrogen partial pressure = 20 mmHg, 1430° C × 1 hr, and cooling speed to 1300° C = 20° C/min.

Table 1

| Sample No.* | Mixed Carbonitride | WC | MoC** | Co | Ni | Other Additives |
|---|---|---|---|---|---|---|
| (2) | $(Ti_{0.75}W_{0.25})(C_{0.73}N_{0.27})_{0.95}$ 58.0% | 3.9% | — | 6.6% | 3.5% | $(Ta_{0.75}Nb_{0.25})C$ 27.0% |
| (3) | $(Ti_{0.75}W_{0.25})(C_{0.73}N_{0.27})_{0.95}$ 49.4% | 21.7% | — | 8.9% | 8.9% | $(Ta_{0.95}Nb_{0.25})C$ 19.1% |
| (4) | $(Ti_{0.8}W_{0.2})(C_{0.74}N_{0.26})_{0.95}$ 54.0% | 14.2% | — | 10.9% | — | $(Ta_{0.75}Nb_{0.25})C$ 20.8% |
| (5) | $(Ti_{0.84}W_{0.16})(C_{0.74}N_{0.27})_{0.96}$ 48.4% | 15.6% | — | 6.5% | 6.4% | TaC 23.1% |
| (6) | $(Ti_{0.8}W_{0.2})(C_{0.74}N_{0.26})_{0.95}$ 54.9% | 9.8% | 2.5% | 7.6% | 4.0% | $(Ta_{0.75}Nb_{0.25})C$ 21.2% |

Note:
Alloys of Our Invention
**Added as $Mo_2C$ + C

It was found by the observation through a microscope that these alloys all consisted of two hard phases and a binder metal phase, one of the hard phase being WC and the other being a B1 type crystal by X-ray diffraction. The properties of these alloys are shown in Table 2.

Table 2

| Sample No. | Transverse Rupture Strength (kg/cm²) | VHN |
|---|---|---|
| (2) | 170 | 1600 |
| (3) | 157 | 1620 |
| (4) | 165 | 1585 |
| (5) | 171 | 1553 |
| (6) | 163 | 1607 |

Comparison tests of cutting performance were then carried out using Sample Alloy Nos. (2) to (6) and a commercial TiC base cermet (A) and P10 grade cemented carbides (B) as shown in Table 3.

Table 3

| Comparative Alloy | Composition | Alloy Property TRS (kg/mm²) | VHN |
|---|---|---|---|
| TiC Base Cermet (A) | TiC-15%$Mo_2$-15%Ni | 148 | 1480 |
| Cemented Carbides (P 10 Grade) (B) | 55%WC-20%TiC-16%TaNbC-9%Co | 153 | 1550 |

As the cutting performance there were examined (1) wear resistance, (2) toughness in interrupted cutting (including thermal fatigue resistance toughness) and (3) plastic deformation resistance to thus obtain results shown in Table 4. The conditions of each test are summarized under Table 4.

Table 4

| Sample No. | (1) Wear Resistance* Flank Wear (mm) | Crater Depth (mm) | (2) Interrupted Cutting** | (3) Plastic Deformation*** Nose Push (mm) |
|---|---|---|---|---|
| (2) | 0.08 | 0.03 | cutting up to 1000 cycles | 0.02 |
| (3) | 0.10 | 0.06 | cutting 1000 cycles or more | 0.02 |
| (4) | 0.10 | 0.04 | broken at 900 cycles | 0.02 |
| (5) | 0.12 | 0.03 | broken at 700 to 900 cycles | 0.04 |
| (6) | 0.10 | 0.04 | broken at 900 cycles | 0.03 |
| (A) | 0.10 | 0.02 | broken at 30 cycles | 0.15 |
| (B) | 0.4 | 0.15 | broken at 700 cycles | 0.06 |

Cutting Conditions
Workpiece: SCM 3H Hs = 40
Cutting Speed: 170 m/min, Cutting Depth: 1.5 mm
Feed: 0.36 mm/rev, Cutting Time: 10 minutes
Workpiece: S 50 C (120 ϕ), Interrupted cutting to form a V-type groove in the longitudinal direction
Cutting Speed: 150 m/min
Cutting Depth: 1,5 mm, Feed: 0.59 mm/rev
Workpiece: SNCM 9 H Hs = 45
Cutting Speed: 200 m/min
Cutting Depth: 1.5 mm, Feed: 0.36 mm/rev
Cutting Time: 1 minute In the Interrupted Cutting Test (2) of Table 4, the conditions are so adjusted that the breakage of a tool does not occur suddenly and the tool is subjected to cycles of stress and heat and broken through a previous stage of cracking. Therefore, the thermal fatigue resistance toughness can also be assessed from the data of this test. As evident from the results of Table 4, the commercial TiC base cermet (A) is very superior in crater wear resistance but markedly inferior in plastic deformation resistance and toughness (including thermal fatigue resistance toughness) and the P 10 grade cemented carbides (B) is relatively excellent in toughness, but somewhat inferior in plastic deformation resistance and markedly inferior in wear resistance in a high speed cutting. On the contrary, the alloys (2) to (6) of the present invention are excellent in plastic deformation resistance and, surprisingly, show substantially equal toughness (including thermal fatigue resistance toughness) to cemented carbides, while holding a considerable wear resistance comparable to TiC base cermets.

EXAMPLE 3

8.8% of commercial tungsten carbide powder of 1.3 microns (by Fischer's Sub Sieve Sizer), 38.9% of titanium carbide powder of 1.2 microns, 27.5% of niobium nitride powder of 1.5 microns, 8.8% of molybdenum carbide powder of 2.0 microns, 0.5% of carbon black, 8.0% of nickel powder and 8.0% of cobalt powder were weighed, ball milled by wet process for 96 hours, dried, compressed under a pressure of 1 ton/cm$^2$ and the formed body was subjected to reduced pressure sintering at a sintering temperature of 1350° to 1450° C under a nitrogen partial pressure of 50 Torr for 1 hour. In the resulting alloy there were found two hard phases by observation of a microscope. It was cofirmed by X-ray diffraction that these hard phases were a hard phase of B1 type and WC phase. The quantity of the WC phase was approximately 9% by calculating from the micrograph and specific gravity of the alloy and it was assumed from this datum that W was not contained in the hard phase of B1 type. Therefore, the molecular formula of the B1 type hard phase was $(Ti_{0.65}Nb_{0.26}Mo_{0.09})(C_{0.74}N_{0.26})_{1.0}$ and VEC calculated from this molecular formula and Formula (2) was 8.7.

A wear resistance test and toughness test were carried out as to the resulting alloy (Sample No. 7) with a cemented carbides of P 10 grade and TiC-Mo-Ni base cermet for comparison, thus obtaining results shown in Table 5. It is apparent from these results that the alloys of the invention is superior.

Table 5

| | Wear Resistance* | | | Transverse Rupture Strength (kg/mm$^2$) |
|---|---|---|---|---|
| | Flank Wear (mm) | Crater Depth (mm) | Interrupted Cutting** | |
| Sample (7) of our invention | 0.10 | 0.04 | cutting up to 1000 cycles | 180 |
| Cemented Carbides P 10 | 0.6 | 0.2 | broken at 700 cycles | 150 |
| TiC-Mo-Ni Base Cermet | 0.10 | 0.04 | broken at 2 cycles | 130 |

Cutting Conditions
Workpiece : SCM 3 H Hs = 40
Cutting Speed : 170 m/min,
Cutting Depth : 1.5 mm, Feed : 0.36 mm/rev
Cutting Time : 10 minutes
Workpiece : S 60 C Grooved
Cutting Speed : 150 m/min,
Cutting Depth : 1.5 mm, Feed : 0.59 mm/rev

EXAMPLE 4

The procedure of Example 3 was repeated except using niobium carbide and titanium nitride instead of the niobium nitride to prepare an alloy having the same composition. In the resulting alloy (Sample No. (8)), there was similarly found WC phase. This alloy had a transverse rupture strength of 175 kg/mm$^2$ and flank wear of 0.09 mm and crater depth of 0.03 mm under the same condition as those of Example 3.

EXAMPLE 5

The same raw material as that of Example 3 except the tungsten carbide, cobalt and nickel was hot pressed at 1800° C for 10 minutes to prepare an even solid solution, ground by means of a jaw crusher and a ball mill to a grain size of −100 mesh (Tyler Standard sieve) and mixed with tungsten carbide, cobalt and nickel to prepare an alloy (Sample No. (9)). In the resulting alloy there was similarly found WC phase. This alloy had a transverse rupture strength of 170 kg/mm$^2$ and flank wear of 0.12 mm and crater depth of 0.05 mm under the same conditions as that of Example 3.

EXAMPLE 6

Various alloys having analytical compositions represented by mole fractions, as shown in Tables 6 and 7, were prepared from carbonitrides in an manner analogous to Example 1 and subjected to alloy tests and cutting tests, thus obtaining results shown in Tables 6 and 7. These alloys all consisted of a hard phase of B1 type, WC phase and binder phase. In Samples (15) to (21) and (26) to (29), the cooling speed to 1300° C was 30° C/min and in other samples, it was 20° min. The cutting conditions are summarized under each of Tables 6 and 7.

Table 6

| Sample No. | Analytical Composition* | Transverse Rupture Strength (kg/mm$^2$) | Flank Wear** (mm) | Interrupted Cutting*** |
|---|---|---|---|---|
| (10) | $(Ti_{0.50}Nb_{0.25}Ta_{0.06}Mo_{0.11}W_{0.09})(C_{0.70}N_{0.30})_{1.0} + 0.31(Co_{0.63}Ni_{0.37})$ | 180 | 0.10 | broken at 900 cycles |
| (11) | $(Ti_{0.61}V_{0.11}Nb_{0.13}Mo_{0.08}W_{0.05})(C_{0.76}N_{0.24})_{1.0} + 0.26(Co_{0.69}Ni_{0.31})$ | 180 | 0.09 | " |
| (12) | $(Ti_{0.51}V_{0.35}W_{0.14})(C_{0.65}N_{0.35})_{1.0} + 0.28(Co_{0.65}Ni_{0.35})$ | 150 | 0.09 | broken at 700 cycles |
| (13) | $(Ti_{0.62}Nb_{0.03}Ta_{0.11}W_{0.24})(C_{0.80}N_{0.20})_{1.0} + 0.23Co_{1.0}$ | 180 | 0.10 | broken at 900 cycles |
| (14) | $(Ti_{0.63}Ta_{0.15}W_{0.22})(C_{0.80}N_{0.20})_{1.0} + 0.25(Co_{0.66}Ni_{0.34})$ | 200 | 0.12 | broken at 1000 cycles |
| (15) | $(Ti_{0.52}Nb_{0.04}Ta_{0.14}W_{0.30})(C_{0.82}N_{0.18})_{0.98} + 0.20(Co_{0.70}Ni_{0.30})$ | 160 | 0.12 | cutting 1000 or more cycles |
| (16) | $(Ti_{0.56}Nb_{0.04}Ta_{0.14}W_{0.26})(C_{0.77}N_{0.23})_{0.98} + 0.20(Co_{0.70}Ni_{0.30})$ | 165 | 0.10 | " |
| (17) | $(Ti_{0.56}Nb_{0.04}Ta_{0.14}W_{0.26})(C_{0.83}N_{0.17})_{0.98} + 0.20(Co_{0.70}Ni_{0.30})$ | 160 | 0.11 | " |
| (18) | $(Ti_{0.54}Ta_{0.14}Nb_{0.04}W_{0.28})(C_{0.88}N_{0.12})_{0.97} + 0.20(Co_{0.70}Ni_{0.30})$ | 160 | 0.12 | " |
| (19) | $(Ti_{0.47}Ta_{0.14}Nb_{0.04}W_{0.35})(C_{0.88}N_{0.12})_{0.97} + 0.20(Co_{0.70}Ni_{0.30})$ | 170 | 0.20 | " |
| (20) | $(Ti_{0.53}Ta_{0.14}Nb_{0.04}W_{0.29})(C_{0.92}N_{0.08})_{0.98} + 0.20(CO_{0.80}Ni_{0.20})$ | 155 | 0.20 | broken at 900 cycles |
| (21) | $(Ti_{0.52}Ta_{0.12}Nb_{0.04}W_{0.30})(C_{0.82}N_{0.18})_{0.98} + 0.22(Co_{0.70}Ni_{0.30})$ | 160 | 0.09 | broken at 1000 cycles |
| Cemented Carbides P 10 | | 153 | 0.50 | broken at 700 cycles |

*Analytical Composition represented by mole ratio based on hard phase quantity of
**Cutting Condition similar to Example 1
***Cutting Condition similar to Example 1

Table 7

| Sample No. | Analytical Composition* | Transverse Rupture Strength (kg/mm²) | Cutting Test** Flank Wear (mm) | Crater Depth (mm) |
|---|---|---|---|---|
| (22) | $Ti_{0.30}Nb_{0.12}Mo_{0.04}W_{0.54})(C_{0.88}N_{0.12})_{1.0}$ + 0.21Co | 210 | 0.05 | 0.01 |
| (23) | $(Ti_{0.30}V_{0.12}Mo_{0.04}W_{0.54})(C_{0.88}N_{0.12})_{1.0}$ + 0.21Co | 200 | 0.04 | 0.01 |
| (24) | $(Ti_{0.30}Ta_{0.12}Mo_{0.04}W_{0.54})(C_{0.88}N_{0.12})_{1.0}$ + 0.21Co | 210 | 0.06 | 0.01 |
| (25) | $(Ti_{0.55}W_{0.45})(C_{0.07}N_{0.30})_{1.0}$ + 0.25Co | 185 | 0.10 | — |
| (26) | $(Ti_{0.44}Ta_{0.05}W_{0.51})(C_{0.88}N_{0.12})_{0.98}$ + 0.20Co | 200 | 0.15 | 0.05 |
| (27) | $(Ti_{0.44}Ta_{0.05}W_{0.51})(C_{0.83}N_{0.17})_{0.97}$ + 0.20Co | 220 | 0.04 | 0.01 |
| (28) | $(Ti_{0.44}Ta_{0.05}W_{0.51})(C_{0.78}N_{0.22})_{0.97}$ + 0.20Co | 200 | 0.10 | 0.04 |
| (29) | $(Ti_{0.42}Ta_{0.05}Zr_{0.02}W_{0.51})(C_{0.82}N_{0.19})$ + 0.18Co | 200 | 0.02 | 0.01 |
| Cemented Carbides P 10 | | 180 | 0.40 | — |
| Cemented Carbides P 20 | | 200 | 0.30 | 0.09 |

Note:
*Analytical Composition represented by mole ratio based on hard phase quantity of 1
**Cutting Conditions For Sample No. (25) and Cemented Carbides P 10
Workpiece: S 45 C, Cutting Speed: 150 m/min,
Cutting Depth: 2 mm, Feed: 0.36 mm/rev,
Cutting Time: 10 minutes
Cutting Conditions For Other Samples
Workpiece: S 45 C, Cutting Speed: 100 m/min,
Cutting Depth: 2 mm, Feed: 0.25 mm/rev,
Cutting Time: 30 minutes

EXAMPLE 7

9.6% of titanium nitride powder of 1 micron (by Fischer's Sub Sieve Sizer), 14.1% of titanium carbide powder of 1.5 microns and 76.3% of tungsten carbide powder of 2 microns were mixed, hot pressed at 1800° C for 1 hour and then ground to prepare a mixed carbonitride. Analysis of the resulting carbonitride showed a composition of $(Ti_{0.75}W_{0.25})(C_{0.70}N_{0.30})_1$. It was found by X-ray diffraction that this composition had a crystal structure of B1 type. 49.4% of the resulting mixed carbonitride, 19.1% of $(Ta_{0.75}Nb_{0.25})C$, 21.7% of WC and 9.8% of Co were weighed and mixed with acetone by means of a stainless steel ball mill using superhard balls. The resulting mixture was mixed with camphor in a proportion of 3% and then compressed under a pressure of 2 ton/cm². This formed body was sintered in a vacuum of $10^{-3}$ mmHg up to 1200° C and in nitrogen partial pressure of 1 Torr at a sintering temperature of 1200° C to 1380° C and the sintering was completed while maintaining this nitrogen partial pressure. In the resulting alloy (Sample No. (30)) there was found two hard phases by observation with a microscope, which were a B1-type hard phase and WC phase. On the other hand, the same composition was sintered in vacuum up to 1380° C and under a flow of a mixed gas of $CH_4$ and $H_2$ with 1 Torr at the sintering temperature. On the surface of the resulting alloy (Sample No. (31)) there were found a hard phase of B1 type and Co phase only and inside there were WC phase, B1-type hard phase and Co phase.

A wear resistance test and toughness test by interrupted cutting were carried out using the above described alloys according to the present invention and a cemented carbides of P 10 grade and TiC-Mo-Ni base cermet for comparison, thus obtaining results as shown in Table 8. It is apparent from these results that the alloys of the invention are superior.

Table 8

| Sample No. | Wear Resistance* Flank Wear (mm) | Crater Depth (mm) | Interrupted Cutting Test** |
|---|---|---|---|
| (31) | 0.05 | 0.02 | cutting continued up to 1100 cycles |
| (30) | 0.10 | 0.10 | " |
| Cemented Carbide P10 | 0.6 | 0.2 | broken at 700 cycles |

Table 8-continued

| Sample No. | Wear Resistance* Flank Wear (mm) | Crater Depth (mm) | Interrupted Cutting Test** |
|---|---|---|---|
| TiC-Mo-Ni Base Cermet | 0.10 | 0.04 | broken at 2 cycles |

Cutting Conditions
*Workpiece: SCH 3H Hs = 40, Cutting Speed: 170 m/min
Cutting Depth: 1.5 mm, Feed: 0.36 mm/rev
Cutting Time: 1 minutes
**Workpiece: S 50 C grooved, Cutting Speed: 150 m/min
Cutting Depth: 1.5 mm, Feed: 0.59 mm/rev As apparent from the above described examples, the carbonitride alloys of the invention corresponding to the cases of $0.10 \leqq Y \leqq 0.40$ and $A + B \geqq 0.6$ in Formula (1) have partiticularly higher wear resistance and higher toughness than cemented carbides P 10 (cf, Examples 2, 3, 4 and 5, and Sample Nos. 10 - 19 of Example 6), and those corresponding to the cases of $A \leqq C$ and/or $A + B \leqq 0.6$ and $1-(10/3)Y \leqq C \leqq 1-(10/5)Y$ are particularly excellent in toughness more than Cemented Carbides P20 (cf. Example 1 and Sample Nos. 27–29). The alloy of Sample No. 27 is superior in toughness and wear resistance to that of Sample No. 26 and the alloy of Sample No. 28 is superior in wear resistance to that of Sample No. 26. The alloy of Sample No. 26 belongs to the case of $A \leqq C$ and/or $A + B \leqq 0.6$ and $1-5Y \leqq C \leqq 1-(10/5Y$.

What is claimed is:

1. A cemented carbonitride alloy having a hard phase consisting essentially of $[(\text{Group IVa metal})_A(\text{Group Va metal})_B(\text{Group VIa metal})_C]\ (C_XN_Y)_Z$, wherein $A$, $B$, $C$, $X$ and $Y$ represent mole fractions, $Z$ is the mole ratio of the metalloid components to the metal components, and $A$, $B$, $C$, $X$, $Y$ and $Z$ satisfy the equations $$A + B + C = 1,$$

$$X + Y = 1,$$

$$4A + 5B + 6C + 4XZ + 5YZ \geqq 8.6,$$

$$0.05 \leqq Y \leqq 0.50 \text{ and}$$

$$0.85 \leqq Z \leqq 1.0,$$

and wherein the hard phase is combined by at least one binder metal selected from the group consisting of iron, cobalt and nickel and there are in the alloy structure WC phase and the hard phase having a B1 crystal structure and containing Ti in a proportion of at least 20 atomic percent to the metallic atoms.

2. The cemented carbonitride alloy of claim 1, wherein the content of nitrogen in the surface layer of said alloy is smaller than the content of nitrogen in the interior of said alloy.

3. The cemented carbonitride alloy of claim 1, wherein at least one of the conditions of $A \leqq C$ and $A + B \leqq 0.6$ is satisfied and the relation of $1 - (10/3)Y \leqq C \leqq 1 - (10/5)Y$ is satisfied.

4. The cemented carbonitride alloy of claim 1, wherein at least one of the conditions $A \leqq C$ and $A + B \leqq 0.6$ is satisfied and the relation of $1 - 5Y \leqq C \leqq 1 - 2Y$ is satisfied.

5. The cemented carbonitride alloy of claim 1, wherein the relation of $A + B \leqq 0.6$ is satisfied.

6. The cemented carbonitride alloy of claim 1, wherein the relation of $A \leqq C$ is satisfied.

7. The cemented carbonitride alloy of claim 1, wherein the relation of $A \leqq C$ is satisfied.

8. The cemented carbonitride alloy of claim 7, wherein the relation of $A \leqq C$ is satisfied.

9. The cemented carbonitride alloy of claim 7, wherein the relation of $A + B \leqq 0.6$ is satisfied.

10. A process for the production of the cemented carbonitride alloy as claimed in claim 1, which comprises sintering a carbonitride having a composition corresponding to said alloy under a nitrogen partial pressure of $10^{-1}$ to 200 Torr and maintaining the cooling rate from the sintering temperature to the liquid phase-vanishing temperature to at least 20° C/min.

11. The process of claim 10, wherein the absolute pressure during the cooling from the sintering temperature to the liquid phase-vanishing temperature is maintained higher than the absolute pressure during the sintering.

* * * * *